US007181937B2

(12) United States Patent
Keller

(10) Patent No.: US 7,181,937 B2
(45) Date of Patent: Feb. 27, 2007

(54) LOCKING CYLINDER

(75) Inventor: Ernst Keller, Wollerau (CH)

(73) Assignee: Keso AG, Richterswil (CH)

( * ) Notice: Subject to any disclaimer, the term of this patent is extended or adjusted under 35 U.S.C. 154(b) by 0 days.

(21) Appl. No.: 11/152,249

(22) Filed: Jun. 15, 2005

(65) Prior Publication Data

US 2005/0274162 A1 Dec. 15, 2005

(30) Foreign Application Priority Data

Jun. 15, 2004 (CH) ..... 1009/04

(51) Int. Cl.
*E05B 35/08* (2006.01)

(52) U.S. Cl. ..... 70/338; 70/358; 70/383; 70/384; 70/493

(58) Field of Classification Search ..... 70/358, 70/493, 337–343, 382–385, DIG. 60, 367–369, 70/409, 419, 375, 494, 495, DIG. 71, DIG. 75
See application file for complete search history.

(56) References Cited

U.S. PATENT DOCUMENTS

| | | | | | |
|---|---|---|---|---|---|
| 2,326,358 | A * | 8/1943 | Hull | 70/385 |
| 2,427,837 | A * | 9/1947 | Connell | 70/383 |
| 2,910,860 | A * | 11/1959 | Moreno | 70/338 |
| 3,824,818 | A * | 7/1974 | Neale | 70/358 |
| 4,137,739 | A * | 2/1979 | Keller | 70/358 |
| 4,195,504 | A * | 4/1980 | Foshee | 70/369 |
| 4,292,824 | A * | 10/1981 | Keller | 70/373 |
| 4,403,486 | A * | 9/1983 | Miyake | 70/383 |
| 4,732,023 | A * | 3/1988 | Shen | 70/383 |
| 4,770,014 | A * | 9/1988 | Knauer | 70/358 |
| 5,000,019 | A * | 3/1991 | Foster | 70/338 |
| 5,176,015 | A * | 1/1993 | Sussina | 70/369 |
| 5,479,801 | A * | 1/1996 | Keller | 70/373 |
| 5,553,473 | A * | 9/1996 | Keller | 70/358 |
| 5,666,835 | A * | 9/1997 | Keller | 70/397 |
| 5,799,519 | A * | 9/1998 | Hsiao | 70/358 |
| 6,532,781 | B1 * | 3/2003 | Keller | 70/358 |
| 6,935,146 | B1 * | 8/2005 | Lin | 70/338 |
| 2005/0183482 | A1 * | 8/2005 | Lin | 70/493 |

FOREIGN PATENT DOCUMENTS

| | | |
|---|---|---|
| EP | 0 250 701 A2 | 1/1988 |
| EP | 0 918 124 A1 | 5/1999 |
| GB | 2 154 652 A | 9/1985 |

* cited by examiner

*Primary Examiner*—Lloyd A. Gall
(74) *Attorney, Agent, or Firm*—Browdy and Neimark, PLLC

(57) ABSTRACT

The locking cylinder has a basic code which can be changed using at least one change key (17, 17'). A rotor (3) is mounted in a cylinder housing (2*a*, 2*b*) and has a keyway (4) into which a shank of a standard key which is provided with control surfaces 18 can be pushed in order to position the tumblers which are arranged in three first rows (A, B, C). Further tumblers have coding elements (13) which are arranged in further bores in the cylinder housing (2*a*, 2*b*) in a programming position of the rotor (3). The change key (17, 17') interacts with three further rows (D, E, F) of tumblers in the programming position, these tumblers being arranged in slides. These further rows (D, E, F) each contain tumblers having coding elements (C). The locking cylinder can be produced with a smaller outside diameter and be installed in a particularly cost-effective manner.

21 Claims, 8 Drawing Sheets

| | | | | | | | | | | |
|---|---|---|---|---|---|---|---|---|---|---|
| 02 | | X | | K | | X | | X | | X |
| 02 | | X | | X | | K | | K | | X |
| 01 | X | | X | | K | | K | | X | |

| | | | | | | | | | | |
|---|---|---|---|---|---|---|---|---|---|---|
| 02 | | X | | X | | K | | X | | X |
| 02 | | K | | X | | X | | K | | X |
| 01 | X | | K | | X | | K | | X | |

| | | | | | | | | | | |
|---|---|---|---|---|---|---|---|---|---|---|
| 02 | | X | | X | | X | | K | | X |
| 02 | | X | | K | | K | | X | | X |
| 01 | X | | X | | K | | X | | K | |

LOCKING CYLINDER

BACKGROUND OF THE INVENTION

1. Field of the Invention

The invention relates to a locking cylinder having pin tumblers, in which a basic code can be changed using at least one change key, having a cylinder housing in which a rotor is mounted which has a keyway into which a shank of a standard key which is provided with control surfaces can be pushed in order to position the tumblers which are arranged in three first rows, and having further tumblers which have coding elements and which are arranged in further bores in the cylinder housing in a programming position of the rotor.

2. Prior Art

Numerous embodiments of locking cylinders having pin tumblers whose locking arrangement can be changed are already known. For example, EP 0250701 presents a cylinder lock in which at least one pin tumbler has what is known as a combination plate. This combination plate can be accommodated by a recess in the core and thus be removed from the region of the pin tumbler. The locking arrangement of this locking cylinder can be changed without replacing and even without dismantling the lock. This is necessary, for example, when a key is lost.

EP 0918124 A likewise discloses a locking cylinder in which a basic code can be changed. For this purpose, a key has a recess which can accommodate an auxiliary tumbler, and therefore this auxiliary tumbler can be removed or reinserted. Rekeying of this cylinder is comparatively complex and requires an expert.

GB 2154652 A discloses a locking cylinder which has coding disks for collecting locking elements in a separate bore and a separate core. These coding disks can be stored away. The locking cylinder has a plurality of shear lines and can therefore be produced only with a comparatively large outside diameter.

OBJECT AND SUMMARY OF THE INVENTION

The invention is based on the object of providing a locking cylinder of the abovementioned type which ensures a considerably higher locking reliability.

In the case of a generic locking cylinder, the invention is achieved in that the change key interacts with three further rows of tumblers in the programming position, these tumblers being arranged in slides, and these further rows each contain tumblers having coding elements. In the locking cylinder according to the invention, the rekeying can be performed simultaneously in three rows or three bore lines. The rekeying positions, and thus the tumblers having coding elements, can therefore be arranged over three planes and thus over significantly more bores. The rekeying options are significantly increased in this way. This results in significantly higher reliability. The higher reliability is produced in particular by the rekeying positions or the coding positions being reliably disguised. It is therefore impossible to determine the location of the coding positions on the key. On account of the many rekeying options, the owner of the locking cylinder may rekey or program it back and forth several times, for example 10 or 20 times. Key sets which have been used can be archived and reused after a certain period of time. The fact that a small outside diameter and also particularly simple installation are possible as a result of the further rows being arranged in slides is also significant.

According to one development of the invention, provision is made for the cylinder housing to have recesses into each of which a slide is inserted which accommodates housing pins of the pin tumblers. These slides can be produced and fitted with the housing pins before being inserted into the abovementioned recesses. The rotor fitted with the tumbler pins can be installed in the cylinder housing when the slides are inserted, so that the locking cylinder is already functional after the slides are pushed into the housing. This development additionally has the significant advantage that the locking cylinder can be implemented with a customary outside diameter of 17 mm.

One development of the invention provides for the further rows to be arranged asymmetrically with respect to a central plane of the locking cylinder. In this way, it is possible to produce a left-sided version and a right-sided version. This has the significant advantage that central systems can be constructed. In the case of an apartment block, the front door, for example, is then equipped with a left-sided locking cylinder. The apartment doors are then each equipped with a right-sided locking cylinder.

One development of the invention provides for at least one of the three further rows to have a fixed pin position. This pin position is preferably the rearmost position. A standard key can therefore not be used for programming purposes. A special change key or programming key is necessary for programming purposes, this key having a notch into and out of which the radially immobile pin can move. A standard key without this notch cannot be pushed into the keyway as far as the key stop in the programming position. All normal keys are therefore blocked in the programming position.

According to one development of the invention, the locking cylinder is a double locking cylinder. The two cylinder housings are preferably produced separately and connected to a web. The division into two cylinder halves permits particularly simple installation, during which the abovementioned slides are inserted into the recesses in the cylinder halves.

The invention also relates to a locking cylinder. In this case, provision is made for the change key to have at least one notch, which is open at the front, at the front end of the shank. This notch makes it possible to use the key in the programming position in which at least one pin is fixed.

Embodiments having two notches which are arranged to be rotationally symmetrical or four notches which are arranged symmetrically are of course also possible. Two or four fixed pins are correspondingly present in the locking cylinder.

Further advantageous features can be found in the dependent patent claims, the following description and the drawings.

BRIEF DESCRIPTION OF THE DRAWINGS

One exemplary embodiment of the invention is explained in greater detail in the text which follows with reference to the drawing, in which.

DETAILED DESCRIPTION OF THE INVENTION

Figure 1:
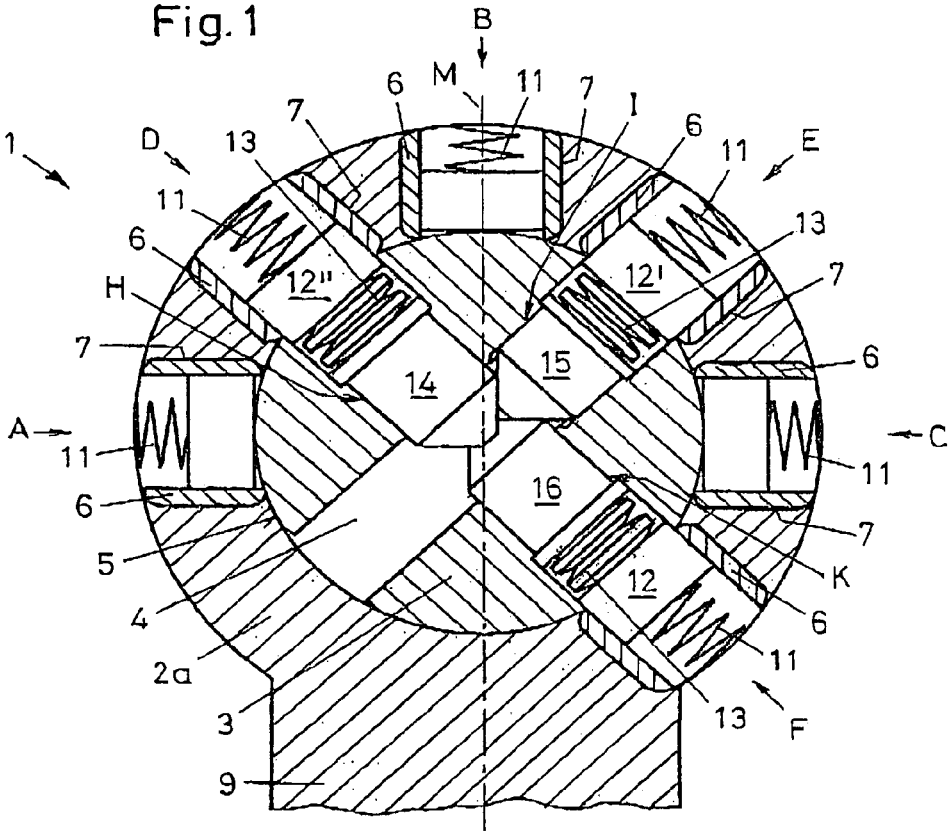
FIG. 1 shows a locking cylinder according to the invention, with the rotor and the tumblers in the installation position.
Figure 16:
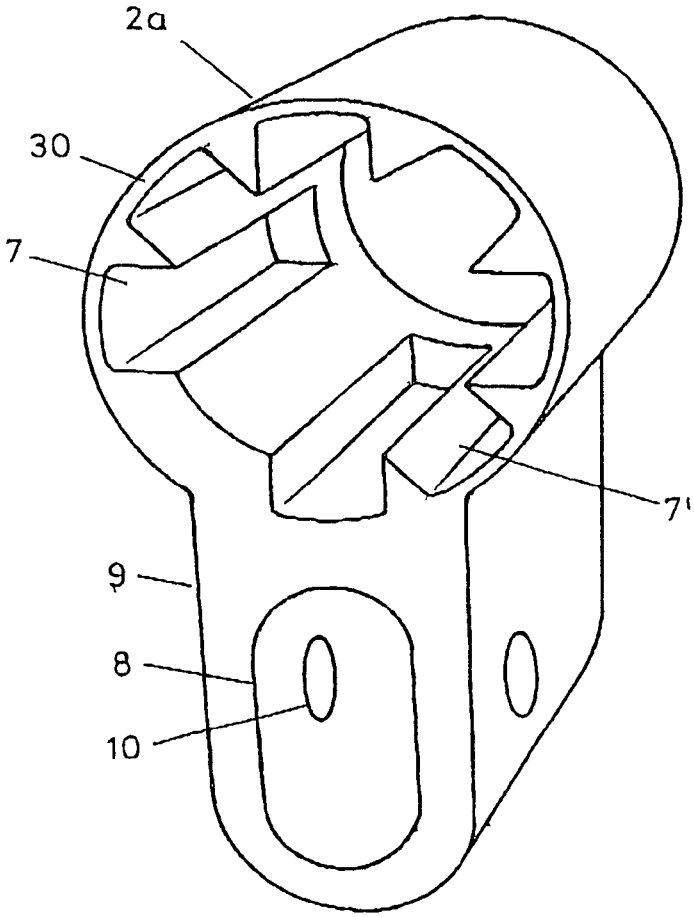
FIG. 16 shows a perspective view of the cylinder housing according to FIG. 14.

The locking cylinder 1 shown in FIG. 1 has a rotor 3 which is mounted in a cylinder housing 2*a*. The cylinder housing 2*a* usually has a cylinder holder 9 which is only partially shown here. It can be seen from FIG. 16 that the cylinder holder 9 has a recess 8 for accommodating a connecting web (not shown here) which connects the cylinder housing 2*a* to a further cylinder housing 2*b*. The locking cylinder is preferably a double locking cylinder having two cylinder housings 2*a* and 2*b* which are firmly connected to one another by a connecting web. The two cylinder housings 2*a* and 2*b* each have bores 10 for accommodating connecting pins (not shown here) for anchoring the connecting web.

The rotor 3 has a keyway 4 for receiving a standard key or a change key 17. The change key 17 or programming key is preferably what is known as a turning key or flat key which, according to FIG. 2, has control surfaces 18 in the shank, these control surfaces being created by bores. The bores may be single bores, stepped bores, milled sections or the like. The bores are preferably arranged in the narrow sides and in the side surfaces of the key shank.

Figure 13A:
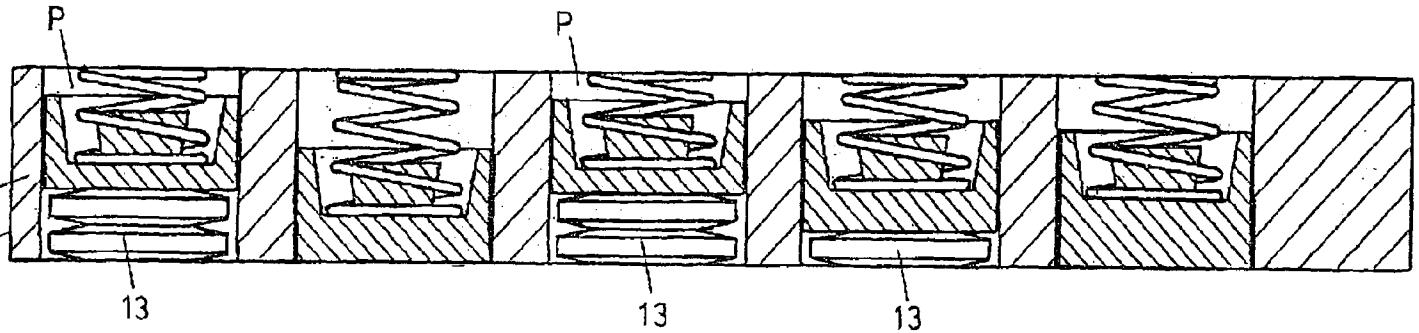
Figure 13B:
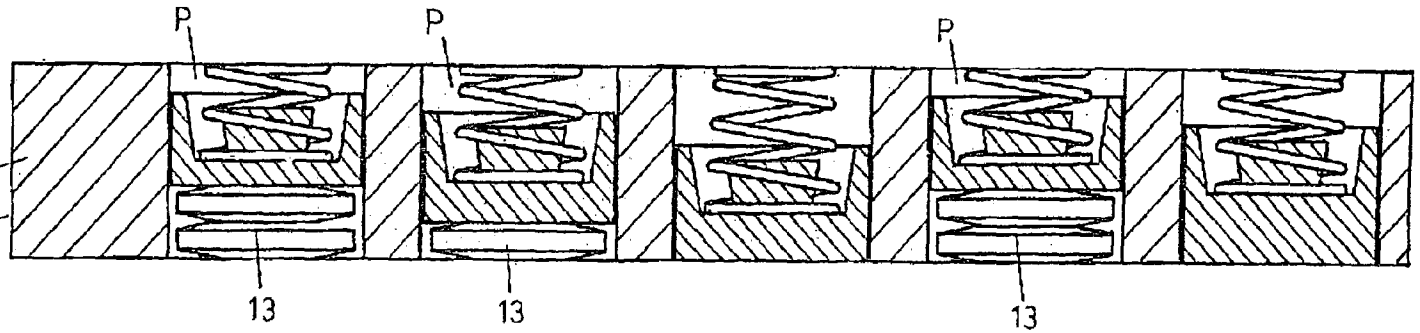
Figure 13C:
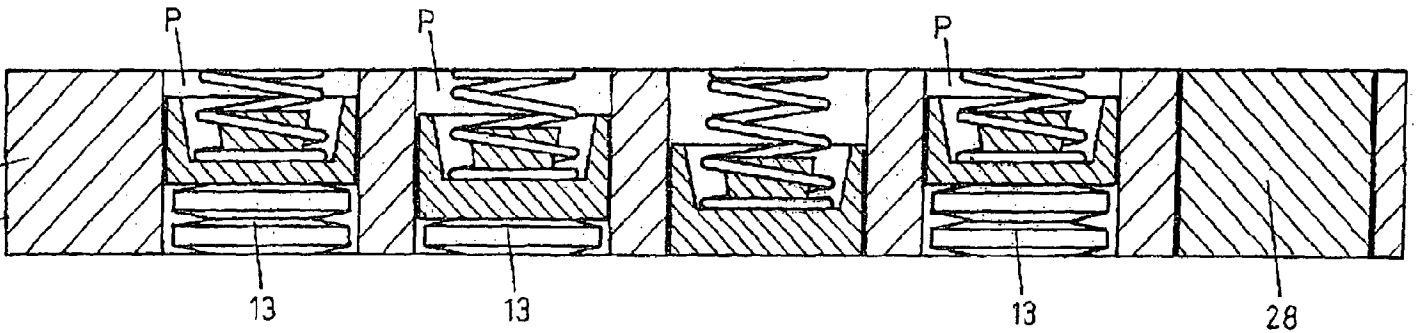

The cylinder housing 2*a* has six recesses 7 which extend in longitudinal directions of the keyway 4 and which each accommodate a slide 6. According to FIGS. 13*a* to 13*c*, the slides 6 each have a plurality of bores in various bore patterns, which bores are arranged in a row and each accommodate a housing pin 12 and, in some cases, at least one coding element 13. The housing pins 12 are each supported against a comparatively thin housing wall 30 (shown in FIG. 16) by a helical spring 11 or another suitable spring element. This housing wall 30 is not shown in FIGS. 1 to 9 for illustrative reasons. The housing pins 12 are of different lengths, as shown in FIGS. 13*a* to 13*c* for example.

The slides 6 having the springs 11, the housing pins 12 and possibly the coding elements 13 form tumbler rows A to F. The tumbler rows A, B and C interact with the standard key. In contrast, the tumbler rows D, E and F serve merely to rekey or program the locking arrangements. As can be seen, the tumbler rows A, B and C according to FIG. 1 are arranged symmetrically with respect to a central plane M. The tumbler row A is in the nine o'clock position, the tumbler row B is in the twelve o'clock position, and the tumbler row C is in the three o'clock position. However, the tumbler rows D, E and F which are provided for rekeying or programming purposes are arranged asymmetrically with respect to the central plane M, as can also be seen in FIG. 1. The tumbler row D is in the half past ten position, the tumbler row E is in the half past one position, and the tumbler row F is in the half past four position. These tumbler rows D, E and F are turned clockwise through 45° with respect to the tumbler rows A, B and C.

The rotor 3 is provided with three bore rows H, I and K, the first bore row H having core pins 14, the second bore row I having core pins 15 and the third bore row K having core pins 16. These pins 14, 15 and 16 generally have different lengths, even within one bore row. Core pins such as these are well known per se.

The rekeying of a locking arrangement using a change key 17 is explained in greater detail below with reference to FIGS. 1 to 4.

Figure 2:
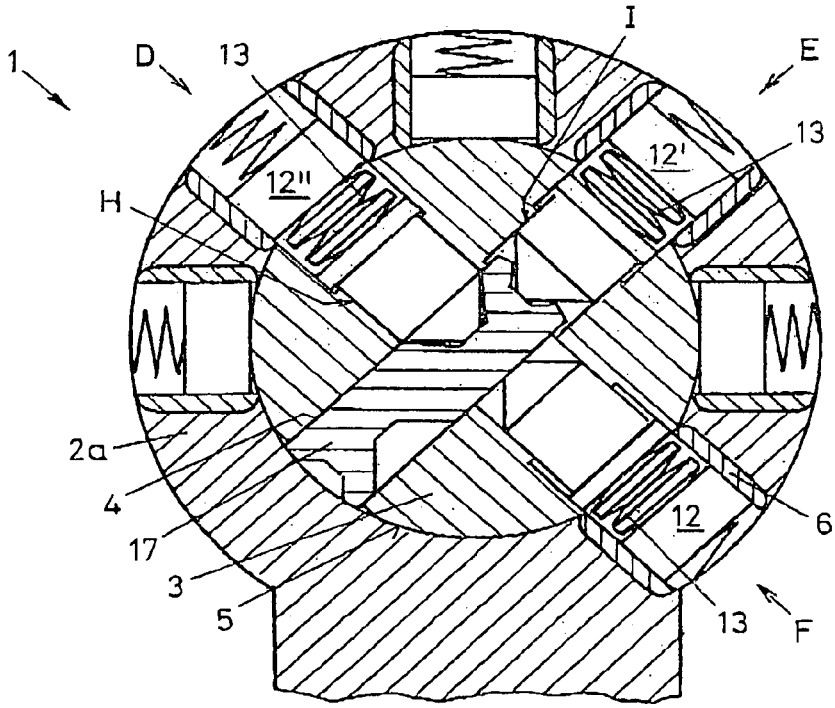
FIG. 2 shows the cylinder according to FIG. 1, but with the change key inserted.

FIG. 1 shows the locking cylinder 1 in the basic position after installation. The tumblers having the core pins 14, 15 and 16 are in the blocking position and are therefore not positioned by a key. The shear line 5 between the rotor 3 and the cylinder housing 2*a* is crossed by the housing pins 12, 12' and 12" and the rotor 3 is thus locked to the cylinder housing 2*a*. The rotor 3 is in the programming position here, that is to say is turned clockwise through 45° with respect to the central plane M. If they change key 17 is now inserted into the keyway 4 as shown in FIG. 2, the tumblers of the tumbler rows D, E and F are displaced radially outward. The housing pins 12, 12' and 12" no longer form a block.

As further shown in FIG. 2, two coding elements 13 of the tumbler row F are moved outward across the shear line 5 into the corresponding slide. One coding element 13 is located in the bore row I. Furthermore, two coding elements 13 are located in the bore row H.

Figure 3:
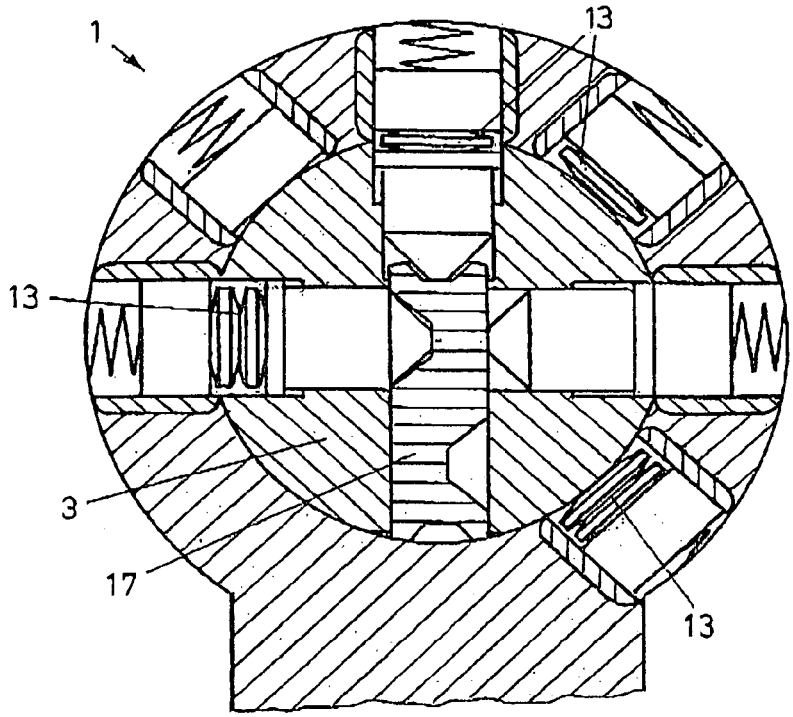
FIG. 3 shows the locking cylinder after a reprogramming operation.
Figure 4:
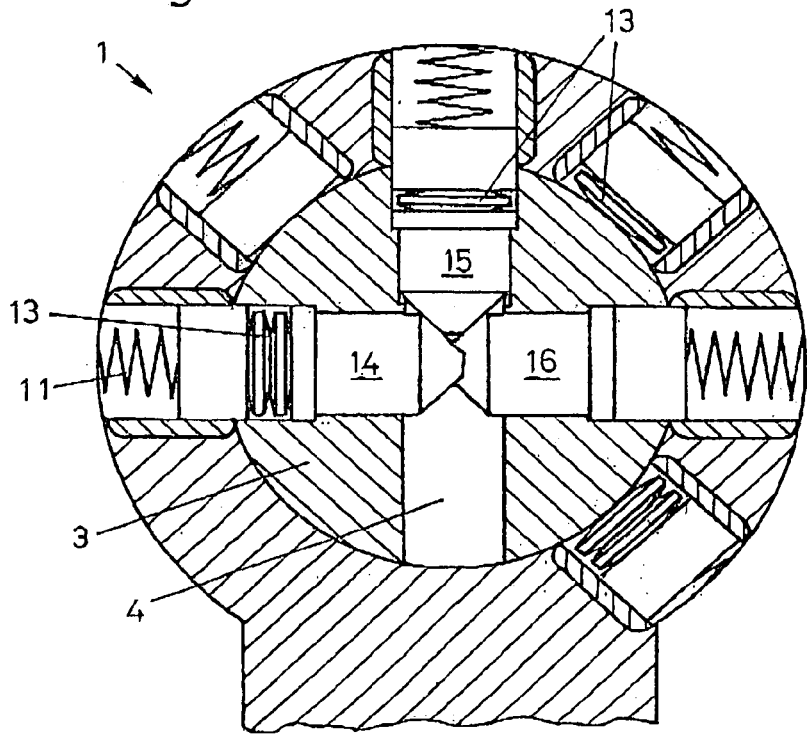
FIG. 4 shows the locking cylinder with the key withdrawn.

As shown in FIG. 3, the rotor 3 is next turned through 45° by turning the change key 17 in the counterclockwise direction. As a result, the coding elements 13 in the rotor 3 are also turned through 45° in the counterclockwise direction. These coding elements therefore change position. As shown in FIG. 4, the change key 17 is then withdrawn. The tumblers are then moved radially inward by the action of the springs 11 until the tips of the core pins 14, 15 and 16 touch. The rotor 3 is blocked as a result. This naturally applies simultaneously not only for three tumblers but for each of three rows of tumblers. The rekeying of the locking arrangement is thus concluded. As can be seen, rekeying such as this is extremely simple and can be performed very quickly by anyone in a few seconds.

Figure 5:
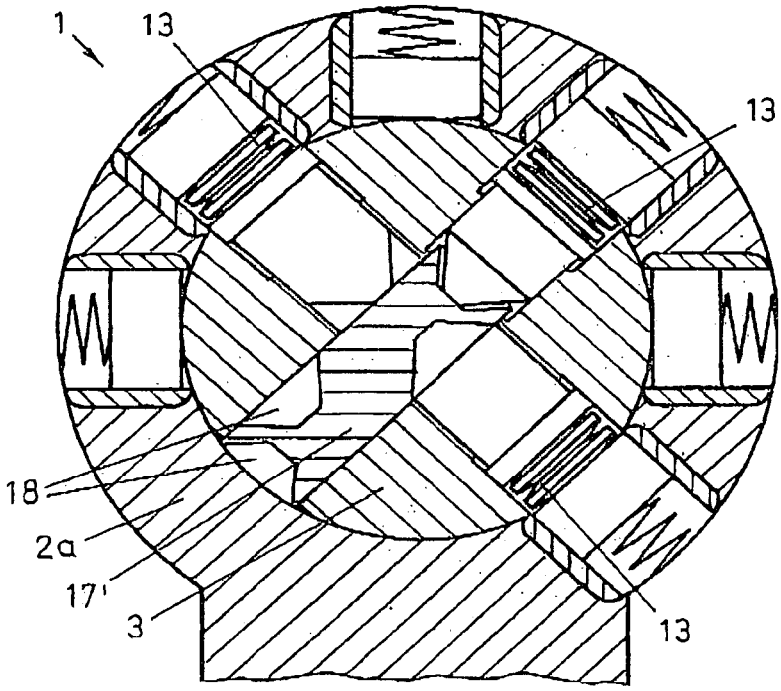
FIG. 5 shows the locking cylinder in the programming position with a second change key inserted.
Figure 6:
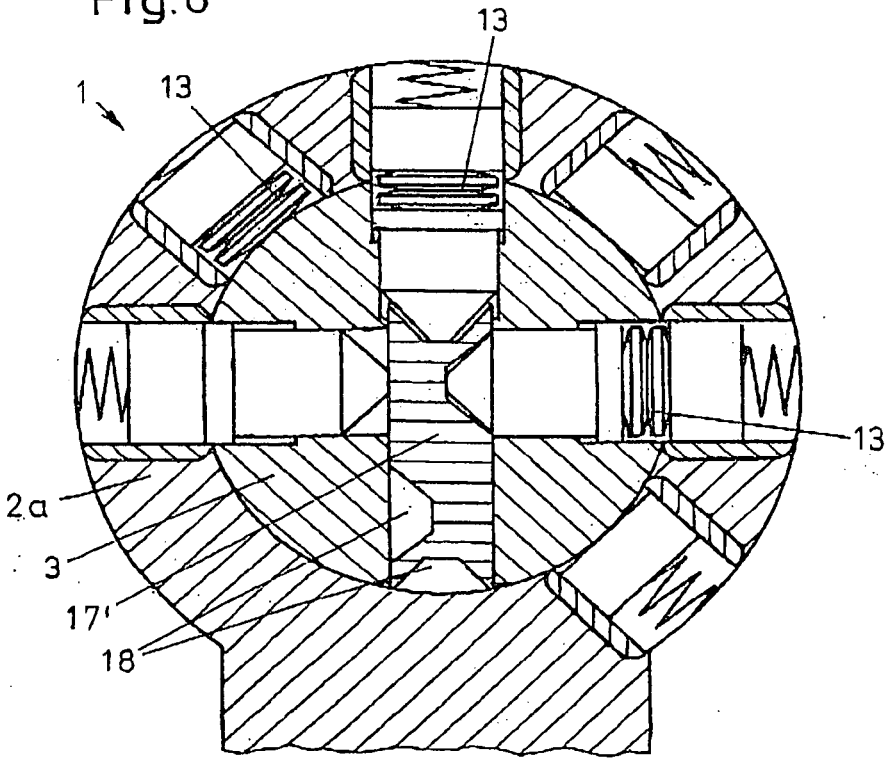
FIG. 6 shows the locking cylinder after reprogramming using the second change key.
Figure 7:
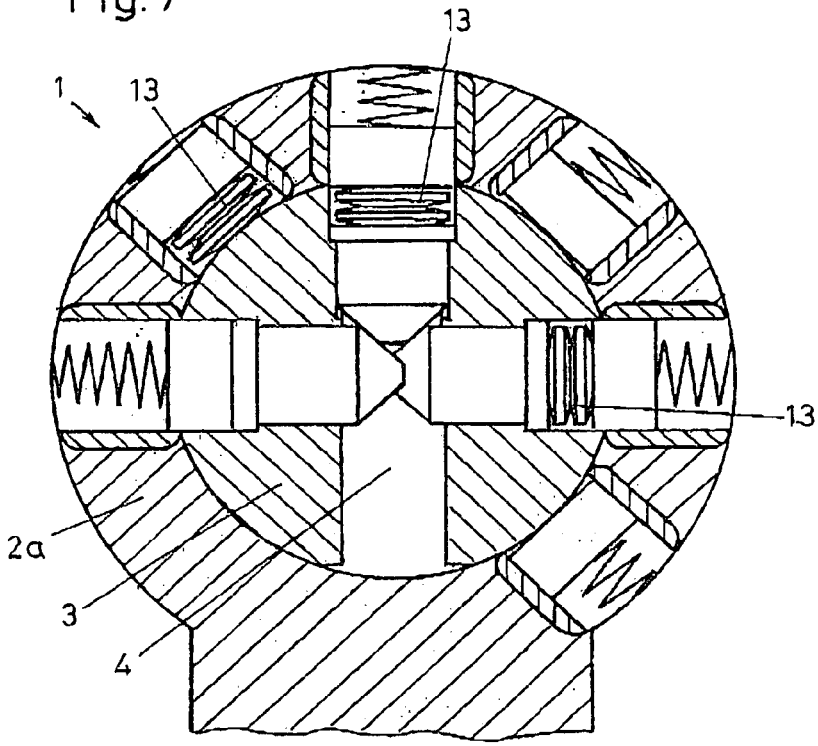
FIG. 7 shows the locking cylinder after the change key of the second type is withdrawn.

FIGS. 5 to 7 show rekeying using a change key 17', where FIG. 5 corresponds to FIG. 2, but with the tumblers being radially offset in a correspondingly different manner in accordance with the various control surfaces of the change key 7'. The coding elements 13 are distributed over the rotor 3 and the cylinder housing 2*a* in a correspondingly different manner. The two coding elements 13 at the top left are located in the cylinder housing 2*a* when the change key 17' is inserted, while the two coding elements 13 are each located in the rotor 3 in the other positions. The rotor 3 is then turned counterclockwise through 45° into the position shown in FIG. 6 using the change key 17'. The change key 17' is then withdrawn, and this is followed by the tumblers falling into the position shown in FIG. 7. The rekeying is thus complete. As can be seen, the locking arrangement according to FIG. 7 is different to that according to FIG. 4. This is to say, the locking cylinder according to FIG. 7 requires a different key to the one according to FIG. 4 in order to position the tumblers. The locking cylinders according to FIGS. 4 and 7 can be rekeyed again as desired.

The arrangement according to FIG. 4 can thus be achieved starting from the arrangement according to FIG. 7, and vice versa. A used key set can be deactivated, archived and reused after a few years by rekeying the locking cylinder 1.

Figure 8:
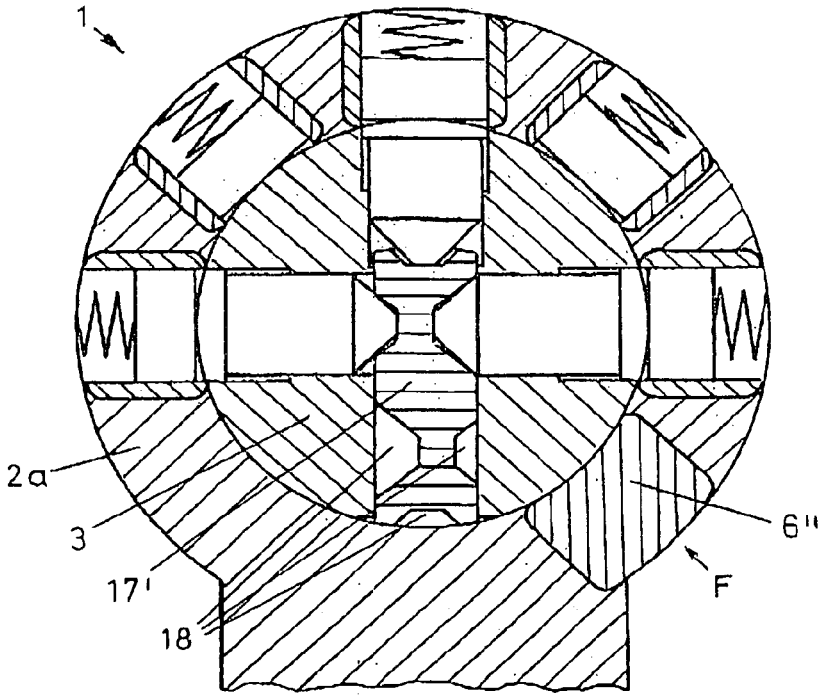
FIG. 8 shows a further section through the locking cylinder according to the invention.
Figures 9, 10:
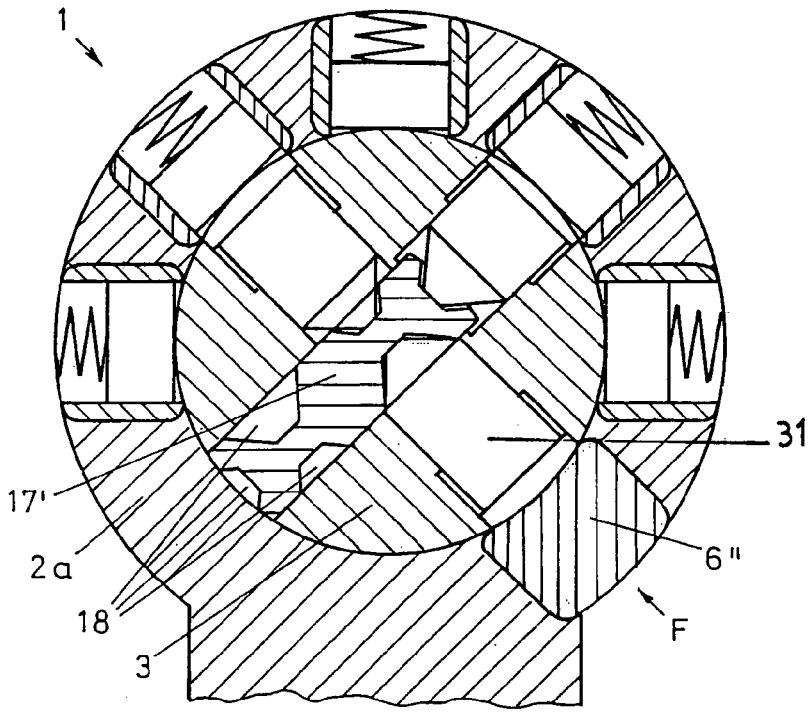
FIG. 9 shows a section according to FIG. 8, but with the rotor in the programming position.
FIG. 10 shows examples of coding cards.
Figure 11A:
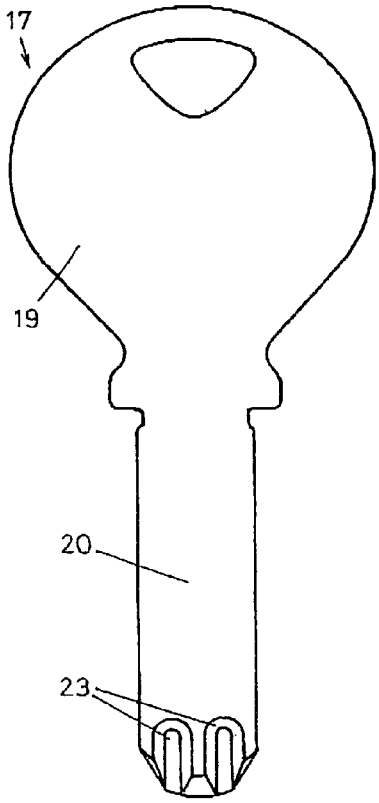
FIGS. 11*a*–11*c* show three exemplary embodiments of programming keys according to the invention, FIGS. 12*a*–12*c* front views of the keys according to FIGS. 11*a*–11*c*, FIGS. 13*a*–13*c* show longitudinal sections through fitted slides.
Figure 11B:
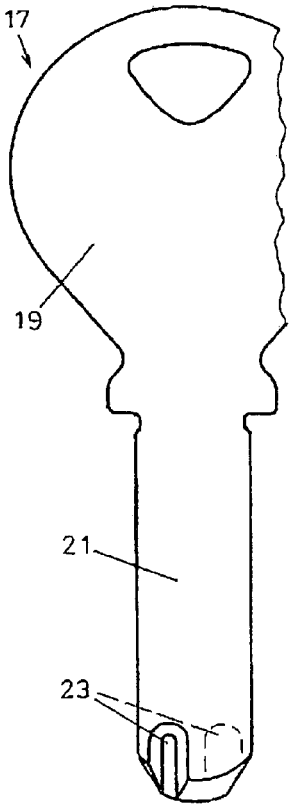
Figure 11C:
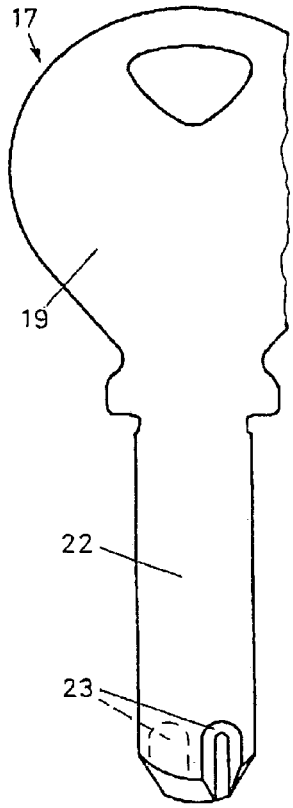
Figure 12A:
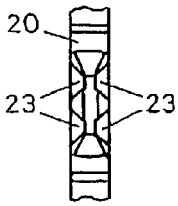
Figure 12B:
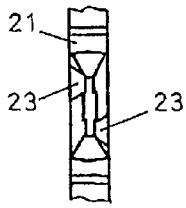
Figure 12C:
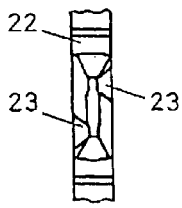

As shown in FIG. 8, the last bore position of the tumbler row F does not have a radial bore into which the core pin 31 shown in FIG. 9 could radially move. The result of this is that this pin position is radially fixed. If the rotor 3 is now turned to the rekeying position according to FIG. 9 using a standard key, this standard key cannot be withdrawn in this position. It also impossible to fully push a standard key into the keyway 4 when the rotor 3 is in the rekeying position since the core pin 31 butts against the front end of the standard key and prevents it from penetrating any further. Therefore, a standard key cannot be used to rekey a locking arrangement. In order for this to be possible using the change key 17 or 17', according to FIGS. 11*a* to 11*c* and 12*a* to 12*c*, said change key has notches 23 at the front end, these notches extending in the longitudinal direction of the shank 20, 21 or 22 and being open at the front. The number of notches 23 in the change key 17 corresponds to the number of fixed core pins 31. According to FIGS. 12*b* and 12*c*, two notches 23 or four or else six notches 23 may be arranged to be rotationally symmetrical.

FIGS. 13*a*, 13*b* and 13*c* respectively show longitudinal sections through the fitted slides 6, 6' and 6" of the tumbler rows D, E and F. As can be seen, each slide 6, 6' and 6" has a plurality of coding positions P which each have at least one coding disk 13. These coding positions P and the bore patterns can be varied in many ways. It is also possible to turn the slide 6 through 180°, so that another arrangement is produced. The slides 61 and 6" thus correspond to the slide 6, but are merely turned through 180°. The slides 6, 6' and 6" can be fitted outside the cylinder and form inserts 24, 25 and 26 which can be automatically installed. In the case of the insert 26, the abovementioned fixed pin position is formed by a pin 28 which is inserted into a corresponding bore in the slide 6".

A fixed core pin 31 correspondingly bears against the pin 28. The inserts 24, 25 and 26 can also be interchanged, so that other locking arrangements are produced in turn. The coding positions P can therefore be varied in three planes and thus over a large number of different bores. This significantly increases the rekeying options and thus reliability. The coding positions P are therefore completely disguised and cannot be identified.

Figure 14:
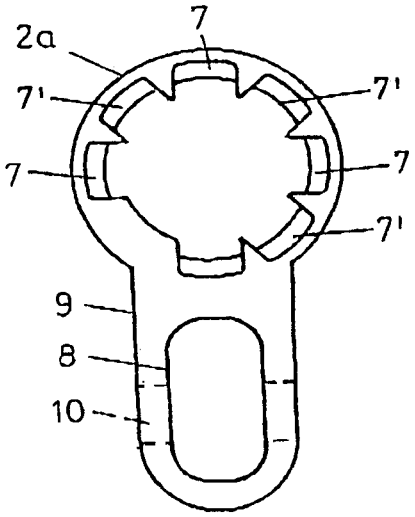
FIG. 14 shows a front view of a cylinder housing with recesses for the slides arranged asymmetrically.
Figure 15:
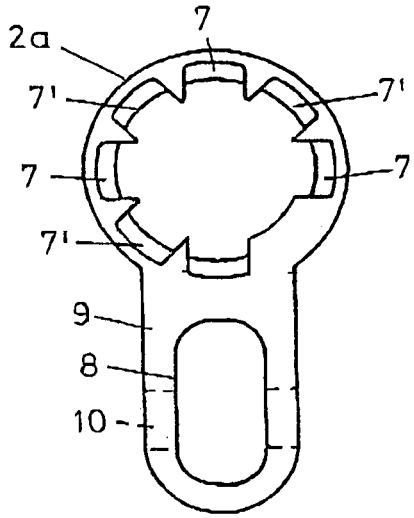
FIG. 15 shows a view according to FIG. 14, with the recesses oriented in a different manner.

The cylinder housing 2*a* may be in the form of the version according to FIG. 14 or in the form of the version according to FIG. 15. The difference between these two versions is the arrangement of the recesses 7. In FIG. 14, three cutouts 7' which are provided for rekeying purposes are turned to the right, whereas in the embodiment according to FIG. 15 these recesses 7' are turned to the left through 45°. This design means that two supplementary independent bore patterns can be included in the programming. As a result, a central system can be constructed. In this case, the cylinder housing 2*a* according to FIG. 14 is, for example, used for the front door and the cylinder housing 2*a* according to FIG. 15 is used for the apartment doors. The change keys 17 for the apartment doors can then not be used to rekey the front door, and vice versa. If the locking cylinder is a double locking cylinder, it correspondingly has two cylinder housings of the version according to FIG. 14 or two cylinder housings according to the version of FIG. 15. FIG. 10 shows three examples of coding cards, where the coding positions are each marked with a K and the customary locking positions are marked with an X.

LIST OF REFERENCE SYMBOLS

1 Locking cylinder
2*a* Cylinder housing
2*b* Cylinder housing.
3 Rotor
4 Keyway
5 Shear face
6 Slide
7 Recess
8 Recess
9 Cylinder holder
10 Bore
11 Spring
12 Housing pin
13 Coding element
14 Core pin
15 Core pin
16 Core pin
17 Change key
18 Control surface
19 Key bow
20 Key shank
21 Key shank
22 Key shank
23 Notch
24 Insert
25 Insert
26 Insert
27 Bore
28 Pin
29 Pin
30 Housing wall
31 Core pin
A Tumbler row
B Tumbler row
C Tumbler row
D Tumbler row
E Tumbler row
F Tumbler row
H Bore row
I Bore row
K Bore row
P Coding position

The invention claimed is:

1. Locking system including a standard key, and at least one change key and a locking cylinder having pin tumblers, in which a basic code can be changed using the at least one change key, said locking cylinder having a cylinder housing in which a rotor is mounted which has a keyway into which a shank of said standard key which is provided with control surfaces can be pushed in order to position the pin tumblers which are arranged in three first rows of bores, and further having three second rows of tumblers which have coding elements and which are arranged in further bores in the cylinder housing in a programming position of the rotor, wherein said at least one change key interacts with said three second rows of tumblers in the programming position, said tumblers of said second rows being arranged in slides, wherein said second rows each contain tumblers having coding elements.

2. Locking system according to claim 1, characterized in that the three second rows are arranged asymmetrically with respect to a central plane of the locking cylinder.

3. Locking system according to claim 1, characterized in that the three first rows and the three second rows are offset rotated through 45°.

4. Locking system according to claim 1, characterized in that the three first rows are arranged symmetrically to a central plane of the locking cylinder.

5. Locking system according to claim 1, characterized in that the coding elements are in the form of disks.

6. Locking system according to claim 1, characterized in that the cylinder housing has recesses into each of which a slide is inserted which accommodates housing pins of the pin tumblers.

7. Locking system according to claim 6, characterized in that six slides are arranged in the cylinder housing, with three slides being arranged in the programming position.

8. Locking system according to claim 1, characterized in that at least one of the further three second rows has a fixed pin position.

9. Locking system according to claim 8, characterized in that the fixed pin position is the rearmost position.

10. Locking system according to claim 1, characterized in that it is a double locking cylinder and has two housing halves which are produced separately.

11. Locking system according to claim 10, characterized in that the two housing halves are firmly connected to one another by a web.

12. Locking system according to claim 10, characterized in that the housing halves are of symmetrical design and are provided either in a version which is turned to the right or in a version which is turned to the left.

13. Locking system according to claim 1, characterized in that the standard key and also the change key have bores by which the abovementioned control surfaces are formed.

14. Locking system according to claim 1, wherein the at least one change key has at least one notch, which is open at the front, at a front end of the shank.

15. Locking system according to claim 14, characterized in that the at least one notch is arranged to be rotationally symmetrical with respect to the longitudinal axis of the key.

16. Locking system according to claim 14, characterized in that the at least one change key is a turning key.

17. Locking system according to claim 11, characterized in that the housing halves are of symmetrical design and are provided either in a version which is turned to the right or in a version which is turned to the left.

18. Locking system according to claim 2, characterized in that the three first rows and the three second rows are offset rotated through 45°.

19. Locking system according to claim 8, characterized in that the three first rows are arranged symmetrically to a central plane of the locking cylinder.

20. Locking system according to claim 19, characterized in that the coding elements are in the form of disks.

21. Locking system according to claim 5, characterized in that the disks are slidable within the cylinder housing between the three first rows and the three second rows.

* * * * *